United States Patent [19]

Kühnis et al.

[11] Patent Number: 4,584,951

[45] Date of Patent: Apr. 29, 1986

[54] THREAD-GUIDING ROLL

[75] Inventors: Ernst Kühnis; Armin Kobler, both of Oberriet; Max Schreiber, Arbon; Hans Wallimann, Goldach, all of Switzerland

[73] Assignee: Aktiengesellschaft Adolph Saurer, Arbon, Switzerland

[21] Appl. No.: 615,114

[22] Filed: May 30, 1984

[30] Foreign Application Priority Data

Jun. 21, 1983 [CH] Switzerland ..... 3379/83

[51] Int. Cl.[4] ..... D05C 11/08

[52] U.S. Cl. ..... 112/97; 474/177; 226/193

[58] Field of Search ..... 112/83, 97; 226/193, 226/186; 474/177, 178, 191, 175; 66/125, 132 R, 146

[56] References Cited

U.S. PATENT DOCUMENTS

| | | | |
|---|---|---|---|
| 1,213,344 | 1/1917 | Eggart et al. | 112/97 |
| 2,920,491 | 1/1960 | Richards | 474/177 X |
| 3,356,050 | 12/1967 | Urscheler | 112/97 |

FOREIGN PATENT DOCUMENTS

| | | | |
|---|---|---|---|
| 29953 | of 1884 | Fed. Rep. of Germany | 112/97 |
| 1177422 | 9/1964 | Fed. Rep. of Germany | 474/177 |
| 1025603 | 1/1953 | France | 474/177 |

*Primary Examiner*—H. Hampton Hunter
*Attorney, Agent, or Firm*—Werner W. Kleeman

[57] ABSTRACT

A freely rotatably mounted roll body couplingly engageable with a brake shaft comprises an exchangeable thread brake liner. The rotatable roll body carrying the thread brake liner in a groove is exchangeably mounted between stationary guide discs which extend radially beyond the roll body on both sides and form a radial continuation of walls of the roll body, laterally defining a thread groove with their radially protruding portions and between which the roll body is exchangeably arranged.

13 Claims, 2 Drawing Figures

THREAD-GUIDING ROLL

BACKGROUND OF THE INVENTION

The present invention broadly relates to thread-guide rolls and, more specifically, pertains to a new and improved construction of a thread-guide roll for a thread supply device of a textile machine, especially for a thread brake device of an embroidering machine, in which the thread supply device comprises a freely rotatably mounted thread-guide roll couplingly engageable with a common brake or drive shaft and having a thread friction liner.

Generally speaking, the thread-guide roll of the present invention is for use with a thread supply device of a textile machine, especially for the thread braking device of an embroidering machine, wherein the thread supply device comprises a freely rotatable thread-guide roll for each thread to be braked or delivered, the thread-guide roll being operatively associatable with a common braking and driving shaft and having a thread friction liner.

For the generation of the necessary tension in threads or the like which are withdrawn from bobbins or packages by the processing or working tools of a textile machine, for instance by the operating or working needles of an embroidering machine, it is known to guide the threads each over a thread-guide roll and to centrally brake these rolls by a brake shaft common to all operating positions. This assures that the thread feed or supply to each processing position is the same independent of both the friction arising during processing and the tension of the thread between the brake shaft and the bobbin or package as well as other unequal or differing conditions for the individual operating positions. This, in turn, guarantees a product which is uniform over all processing or operating positions.

Switchable or engageable brake devices for this purpose are known in which, when engaging or disengaging individual operating positions, the associated processing tools are also simultaneously engaged with or disengaged from the brake shaft, for instance the rolls supplying threads to the individual needles in an embroidering machine. In such switchable or engageable brake devices known from the Swiss Pat. Nos. 515,372, 535,313 and 616,715, a lever carries a freely rotatable thread brake roll which can be coupled to or, for disengaging the operative connection, lifted away from the brake shaft by pivoting the lever by means of control devices which also engage or disengage the processing tools. In each operation or process cycle the corresponding processing tool draws the thread length necessary for the operation. At each such withdrawal of thread the entire system of brake shaft and thread brake roll is rotated to generate the required thread tension. In order that the tension to be generated not be altered by the thread slipping on its roll the latter is provided with a friction liner.

It has been found in practice that there is no known friction or brake liner which is suited to all thread qualities to be processed. Certain types of thread tend to slip on the usual brake liners, others show a marked tendency to climb up the side walls of the rotating roll, which not only detracts from their frictional contact with the brake liner of the roll but also in many cases finally leads to the thread falling out of the roll groove and to operational disturbances.

SUMMARY OF THE INVENTION

Therefore, with the foregoing in mind it is a primary object of the present invention to provide a new and improved construction of a thread-guide roll which does not have associated with it the aforementioned drawbacks and shortcomings of the prior art constructions.

Another and more specific object of the present invention aims at providing a new and improved construction of a thread-guide roll of the previously mentioned type which can be provided with the optimal thread friction liner for each thread to be processed and for the individual application in a simple manner and in which the corresponding thread neither slips nor binds in operation.

Yet a further significant object of the present invention aims at providing a new and improved construction of a thread-guide roll of the character described which is relatively simple in construction and design, extremely economical to manufacture, highly reliable on operation, not readily subject to breakdown and malfunction and requires a minimum of maintenance and servicing.

Now in order to implement these and still further objects of the invention, which will become more readily apparent as the description proceeds, the thread-guide roll of the present invention is manifested by the features that the thread friction or brake liner is exchangeable separately from or conjointly with the component carrying the thread friction or brake liner.

By this simple measure, the thread-guide roll can be provided with the optimal thread friction liner for the corresponding thread for each thread to be processed.

In order to further avoid a climbing up of the thread on the walls of the thread groove and a corresponding ineffectiveness of the thread friction liner, it is proposed according to a particularly advantageous embodiment of the invention that the thread-guide roll comprise a rotatable roll body having the thread brake liner in a groove as well as non-rotating guide discs which radially extend beyond the roll body on both sides and whose peripherally protruding portions form a radial continuation of the walls of the roll body laterally limiting the thread groove and between which the roll body is exchangeably mounted.

If a thread guided in such a roll climbs up on a wall of the groove, it touches one of the stationary guide discs as soon as it tries to leave the friction liner and slides back down onto the friction liner.

A further advantageous embodiment proposes that the roll body have a substantially V-shaped circumferential groove having a depression arranged at its base for the partial accommodation of an exchangeable adhesion or friction liner in the form of a quadrangular, preferably square cross-sectioned ring of elastically soft material which protrudes out of the depression at the base of the V-shaped portion of the circumferential groove and forms a crevice or gap with its side walls in conjunction with the opposing wall of the groove.

A particularly advantageous employment of the thread-guide roll or roller according to the invention is obtained in its employment as a thread brake roll in an embroidering machine.

It will readily be seen that the exemplary constructions of the thread-guide roll are also suited for systems in which the thread guided over the roll is not braked by the latter but is to be delivered by a driven shaft or for systems which deliver or supply thread according to demand and then brake the thread supply again.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components and wherein.

DETAILED DESCRIPTION OF THE PREFERRED EMBODIMENTS

Figure 1:
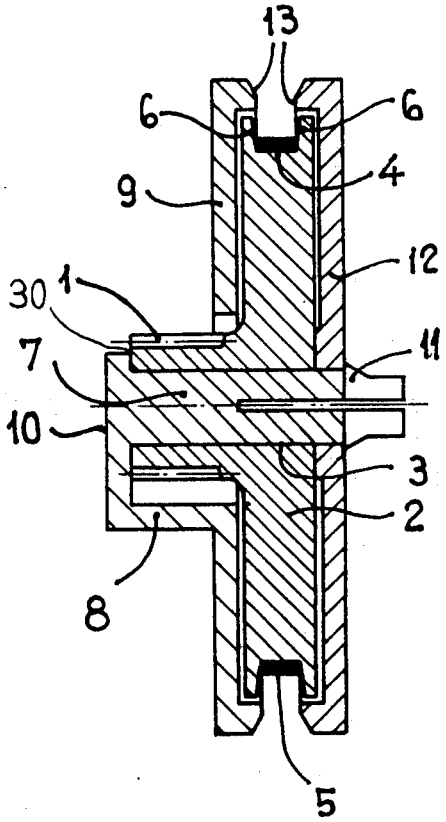
FIG. 1 schematically shows an axial section through a first embodiment of a thread-guide roll according to the invention.

Describing now the drawings, it is to be understood that to simplify the showing of the drawings only enough of the structure of the thread-guide roll has been illustrated therein as is needed to enable one skilled in the art to readily understand the underlying principles and concepts of this invention. The illustrated exemplary embodiment of the thread-guide roll of FIG. 1 takes the form of a thread brake roll or braking roll in the supply or delivery of a thread to an embroidering needle of an embroidering machine. The roll is arranged on a conventional roll lever which pivots between two end positions under the control of an appropriate machine control unit to bring the roll or roller into meshing engagement with a brake shaft not particularly shown in the drawings by means of a pinion 1 or to lift the roll away from such a brake shaft. In the case of a friction drive engagement with the brake shaft, a friction wheel could take the place of the pinion 1, and therefore this component 1 conceptually can be considered to constitute either a pinion or a friction wheel.

The pinion 1 is integrally formed on a roll body 2 which is penetrated by a central axial opening 3 and comprises a groove-shaped depression 4 at its circumference which is lined or coated with a suitable friction liner or covering, in the embodiment shown a thread brake liner or braking liner 5. This liner or covering 5 covers not only the base of the groove or the depression 4 but also the lateral walls 6 of such groove 4 in the embodiment illustrated. The roll body 2 with its pinion 1, or alternatively its friction wheel or other equivalent structure, is freely rotatably mounted upon a spigot, spindle or stub shaft 7 defining an axis of rotation for the roll body 2. The latter protrudes from the center of a guide disc 9 which comprises a hub-shaped protrusion or boss 8 at the root or base of the spigot, spindle or stub shaft 7 with openings or aperture means, generally indicated by reference character 30, in the circumferential wall thereof through which the pinion 1 is engageable with the brake shaft.

At one of its free ends, the spigot, spindle or stub shaft 7 is slotted, as shown, and is provided with an annular shoulder 11. By lightly pressing together the slotted portion, a second guide disc 12 for retaining the roll body 2 can be mounted upon the spigot, spindle or stub shaft 7 to be fixed against rotation but readily removable. The roll body 2 can be removed at any time in the simplest manner from the spigot, spindle or stub shaft 7 after removing the guide disc 12 and can be exchanged for another roll body 2 having, for instance, another friction or brake liner 4 more suited to a different thread groove or thread.

It will readily be seen that both guide discs 9 and 12 conjointly form a component of the thread guide or brake roll illustrated which is non-rotating or fixed in comparison to the roll body 2. The diameter of both guide discs 9 and 12 exceeds that of the roll body 2, so that the guide discs 9 and 12 extend radially beyond the circumference of the roll body 2 at both sides thereof. The surfaces 13 of the portions of the guide discs 9 and 12 peripherally extending beyond the roll body 2 and facing the roll body 2 are formed such that they form a radial continuation of the lateral walls 6 of the thread groove or depression 4 of the roll body 2.

This construction of the thread brake roll with a peripherally outer component defined by the guide discs 9 and 12 which is non-rotating in relation to the thread groove 4 and an inner rotating component defined by the roll body 2 effectively prevents the bothersome climbing of the thread running in the thread groove 4 out of the region of the thread friction or brake liner 5.

In order not to be obliged to exchange the entire roll body 2 for each new thread friction or brake liner, and also for saving material and space, the friction or brake liner could be mounted upon a ring or annulus according to a suitable alternate embodiment not particularly shown in the drawings. The ring would be constructed in suitable manner to be releaseably but non-rotatably mounted upon the remainder of the roll body. In a view of the low forces arising in operation, a simple adhesion connection between the ring and the remaining roll body would suffice. Mutually co-operating profiles, such as cams and grooves, could additionally be provided on both parts to be non-rotatably connected for further security.

The end wall 10 of the protuberance or boss 8 advantageously forms an integral part of the roll lever which, with its pivoting motion between two end positions, engages or disengages the roll from the roll drive and with which the guide disc 9 is advantageously integrally formed. On the other hand, other means of fastening the thread guide or brake roll through one of the guide discs to the roll lever are naturally conceivable.

Figure 2:
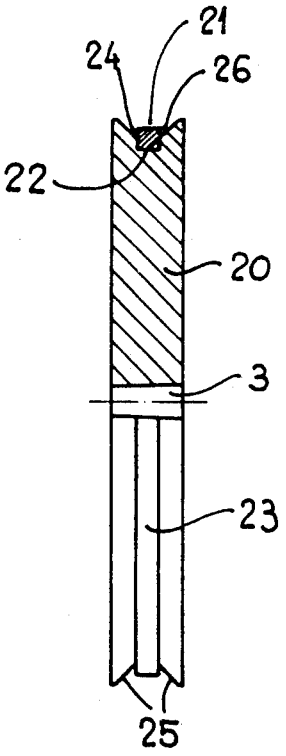
FIG. 2 schematically shows an axial section through a second embodiment.

A further embodiment of a roll body 20 and, in particular, a further embodiment of the thread-accommodating groove thereof, is shown in FIG. 2. The groove 21 formed in the roll body 20 of this embodiment has the general form of a shallow V with a correspondingly broad base angle. The groove 21 comprises a depression or recess 22 having a rectangular cross-section at the base of the groove 21. This depression 22 serves to accommodate and retain a friction or brake liner ring 23 in such manner that the latter protrudes partially out of the depression 22 into the diverging portion of the groove 21, so that its side walls 24 form a crevice or gap 26 with the opposing groove wall 25. The friction or brake liner ring 23 has a quadrangular cross-section, preferably a square cross-section as illustrated, and is made of an elastically soft material, e.g. soft elastic rubber or soft elastic plastic with a suitable coefficient of friction. The ring 23 can therefore be readily removed and, vice versa, also inserted or exchanged by stretching it over the outer rim of the roll body 20. In operation, a thread, which is often withdrawn from the supply in jerks, is drawn along one of the side walls 25 of the groove 21 in the crevice 26 by the tension arising in the thread withdrawn from its supply and is braked by the ensuing contact with the liner ring 23. Should the thread be drawn into the crevice 26 between the liner ring 23 and the depression 22, it can readily be withdrawn therefrom due to the parallel walls of the liner ring 23 limiting this crevice or gap 26 and also due to the soft or pliable nature of such liner ring 23.

While there are shown and described present preferred embodiments of the invention, it is to be distintly understood that the invention is not limited thereto, but may be otherwise variously embodied and practiced within the scope of the following claims. Accordingly,

What is claimed is:

1. In a thread-guide roll for a thread supply device of a textile machine, especially for a thread brake device of an embroidering machine, wherein said thread supply device comprises a freely rotatable thread-guide roll for each thread to be selectively braked or delivered; said thread-guide roll being arranged to selectively engage and disengage a common brake and driving shaft of the textile machine; the improvement which comprises:

the thread-guide roll having a thread friction liner;

a roll body having a substantially V-shaped annular circumferential groove;

a depression formed at the base of said V-shaped annular circumferential groove for partially accommodating said thread friction liner;

the thread friction liner being made of elastically soft material with a substantially quadrangular cross-section;

the thread friction liner protruding out of said depression into the V-shaped annular circumferential groove to define conjointly with an opposing wall of the groove a crevice; and said thread friction liner being exchangeable.

2. The thread-guide roll as defined in claim 1, wherein:

said thread-guide roll defines a component for carrying said thread friction liner; and the thread friction liner being exchangeable conjointly with said component.

3. In a thread-guide roll for a thread supply device of a textile machine, especially for a thread brake device of an embroidering machine, wherein said thread supply device comprises a freely rotatable thread-guide roll for each thread to be selectively braked or delivered; said thread-guide roll being arranged to selectively engage and disengage a brake and driving shaft of the textile machine; the improvement which comprises:

the thread-guide roll having a thread friction liner;

said thread friction liner being exchangeable;

a rotatable roll body having a circumferential groove;

said circumferential groove defining walls of said roll body;

said thread friction liner provided in the circumferential groove;

fixed guide discs at both sides of the roll body extending radially beyond the latter;

said guide discs having peripherally protruding portions forming radial continuations of said walls of the roll body; and the roll body being exchangeably installed between the guide discs.

4. The thread-guide roll as defined in claim 3, wherein:

one of said guide discs comprises a spindle having a free end and extending substantially perpendicularly from the center of said one of said guide discs and defining an axis of rotation for said roll body;

the roll body rotating freely about said axis of rotation; and another of the guide discs being releaseably fixed upon said free end of said spindle.

5. The thread-guide roll as defined in claim 3, wherein:

said one of said guide discs is structured as an integrally formed roll lever for pivotably mounting the thread guide roll.

6. The thread-guide roll as defined in claim 4, wherein:

a pinion is formed integrally with said rotating roll body;

said one of said guide discs comprising a hub-like boss having at least one aperture;

said pinion running within said hub-like boss; and the pinion being capable of couplingly engaging a shaft through said at least one aperture.

7. The thread-guide roll as defined in claim 4, wherein:

a friction wheel is formed integrally with said rotating roll body;

said one of said guide discs comprising a hub-like boss having at least one aperture;

said friction wheel running within said hub-like boss; and the friction wheel being capable of couplingly engaging a shaft through said at at least one aperture.

8. The thread-guide roll as defined in claim 3, comprising:

a ring exchangeably fixed upon said roll body; and said thread friction liner being affixed to said ring.

9. The thread-guide roll as defined in claim 3, comprising:

a roll body having a substantially V-shaped annular circumferential groove;

a depression formed at the base of said V-shaped annular circumferential groove for partially accommodating said thread friction liner;

the thread friction liner being made of elastically soft material with a substantially quadrangular cross-section;

the thread friction liner protruding out of said depression into the V-shaped annular circumferential groove to define conjointly with an opposing wall of the groove a crevice.

10. The thread-guide roll as defined in claim 9, wherein:

said thread friction liner has a square cross-section.

11. The thread-guide roll as defined in claim 1, wherein:

the thread-guide roll is employed as a thread brake roll.

12. A thread supply device for a textile machine. especially an embroidering machine, having a brake and driving shaft, comprising:

a thread-guide roll for each thread to be guided of the textile machine and for selectively engaging and disengaging said brake and driving shaft;

said thread-guide roll being provided with a thread friction liner;

said thread-guide roll comprising a rotatable roll body having an outer circumference;

said rotatable roll body being provided with a circumferential groove;

said thread friction liner being arranged in said circumferential groove;

two fixed guide discs;

said thread-guide roll being freely rotatably journalled between said two fixed guide discs;

said two fixed guide discs comprising a first guide disc and a second guide disc;

said first guide disc forming journal means defining elastically positive engagement means for exchangeably and freely rotatably mounting said thread-guide roll;

said second guide disc releasably positively engaging said journal means of said first guide disc for facilitating exchange of said thread-guide roll; and said two fixed guide discs each comprising circumferentially arranged wall means extending radially beyond said outer circumference of said thread-guide roll and protruding axially toward one another over said outer circumference of said thread-guide roll to conjointly form a stationary radial continuation of said circumferential groove of said thread-guide roll.

13. The thread supply device as defined in claim 6, wherein:

said hub-like boss comprises an integrally formed spindle;

said spindle forming said journal means defining said elastically positive engagement means of said first guide disc for exchangeably and freely rotatably mounting said thread-guide roll; and said spindle having a free end for releasably, stationarily and elastically positively engaging said second guide disc.

* * * * *